US007735827B2

(12) United States Patent
Emanuel

(10) Patent No.: US 7,735,827 B2
(45) Date of Patent: Jun. 15, 2010

(54) FREE TRANSPORT FOR SETTLING AND SINGLING OF LETTERS

(75) Inventor: Matthias Emanuel, Ober-Morlen (DE)

(73) Assignee: Bowe Bell + Howell Company, Durham, NC (US)

( * ) Notice: Subject to any disclaimer, the term of this patent is extended or adjusted under 35 U.S.C. 154(b) by 744 days.

(21) Appl. No.: 11/019,676

(22) Filed: Dec. 23, 2004

(65) Prior Publication Data

US 2005/0146089 A1 Jul. 7, 2005

(30) Foreign Application Priority Data

Dec. 23, 2003 (DE) ..... 103 61 175
Jun. 21, 2004 (DE) ..... 10 2004 029 712

(51) Int. Cl.
*B65H 5/00* (2006.01)

(52) U.S. Cl. ..... 271/270; 271/2; 271/264

(58) Field of Classification Search ..... 271/264, 271/270, 272, 275, 2; 209/900, 655, 703; 193/8; 414/593
See application file for complete search history.

(56) References Cited

U.S. PATENT DOCUMENTS 3,203,534 A 8/1965 Burkhardt et al.
4,119,194 A * 10/1978 Freeman et al. ..... 198/400
4,149,622 A * 4/1979 Bradshaw et al. ..... 198/444
4,534,550 A * 8/1985 Reist ..... 271/183
5,238,236 A * 8/1993 Belec et al. ..... 271/34
5,494,276 A * 2/1996 Faber et al. ..... 271/113

FOREIGN PATENT DOCUMENTS

| | | |
|---|---|---|
| DE | 1116602 | 11/1961 |
| DE | 24 01 530 A | 1/1974 |
| DE | 1 931 189 | 1/1986 |
| FR | 2692565 A1 | 12/1993 |

* cited by examiner

*Primary Examiner*—Patrick Mackey
*Assistant Examiner*—Jeremy Severson
(74) *Attorney, Agent, or Firm*—McDermott Will & Emery LLP

(57) ABSTRACT

The disclosed concepts provide for a method and apparatus for processing batched items, which may comprise a multitude of flats, e.g., letters. The individual items are conveyed in a row and abut against a band conveyor with one edge. They are at least partially resting against and overlapping each other in a shingle-like manner. The overlapping flats are further separated (fanned out) by guiding mechanisms on each side of the overlapping flats that accelerate and decelerate as necessary.

18 Claims, 4 Drawing Sheets

FREE TRANSPORT FOR SETTLING AND SINGLING OF LETTERS

TECHNICAL FIELD

The teachings herein generally relate to an apparatus and method for conveying and separating batched letters, especially individual letters having unique properties.

BACKGROUND

Conventional letter processing devices suffer from well known processing problems resulting from unique properties of each letter. For instance, letters may have varying formats, unequal thicknesses and different weights. Additionally, letters may be damaged or not glued properly, so that dog-ears stick out. These varying properties cause letter jams, multifeeds, etc., thereby reducing processing times. Also, such problems complicate the transport and especially the singling which is necessary for further processing. Due to these problems, preparatory actions from the emptying of the sacks to the feeding of the stacked and bundled letters are performed manually.

All known measures with which these problems have been addressed up to now have been relatively complex and could only be realized at high costs. Due to the great complexity, such measures are especially accident sensitive, only offer a moderate security, and do not contribute to the amelioration of the tool life.

SUMMARY

The disclosed concepts provide for a method for the preparatory processing of bundled flat goods which can be realized by technically simple and inexpensive techniques. Advantageously, this allows for long tool life, great processing speed, and further reduction of staff. Other disclosed concepts provide for a device which can realize such a method without problems, which works reliably and treats individual flat goods gently.

Specifically, the disclosed concepts provide for a method for processing batched items, which may comprise a multitude of flats, e.g., letters. The individual items are conveyed in a row and abut against a band conveyor with one edge. They are at least partially resting against and overlapping each other in a shingle-like manner. The overlapping flats are further separated (fanned out) by later processing steps described herein. The disclosed concepts further relate to a device for processing batched items, e.g., a multitude of flats. The device comprises a band conveyor for conveying each flat standing on one edge, and where the band conveyor comprises a guiding distance which is limited by guiding structures on both sides.

In the examples, means are provided for fanning-out of the flat good standing on edge on the band conveyor. The band conveyor is constructed as an underfloor conveyor. One way to fan-out the flat goods is to preliminarily or periodically brake the stack of letters arriving in a row, which are lying on top of each other in a shingle-like manner. Specifically, the row of individual items is conveyed by the underfloor conveyor, braked by the brake mechanism on one side and on the other side grabbed by drive devices and accelerated towards the single pull-off mechanism. The negative acceleration provided by the brake mechanism on one side and the positive acceleration provided by the drive device on the other side cooperate to increasingly fan out the individual goods which are resting against each other in a shingle-like manner.

More particularly, the flat goods conveyed by the band conveyor are lead towards the brake mechanism with one flat edge before reaching the single pull-off. Relative to the braking mechanism, at first the band conveyor transports or conveys the letters in the middle layers of the flat good more than the letters which abut against the brake mechanism because those that abut are slowed with respect to the conveyance speed of the band conveyor. Thus, the individual goods are increasingly shingled even more than before. On the opposite side, the flat good is engaged by a driven side band such that each of the engaged items is accelerated in the direction of the single pull-off. This measure, too, contributes to further shingling. However, it is not necessary to perform both measures simultaneously on the same section of the band conveyor. They can also affect the letters in succession.

The brake mechanism is configured to brake an individual item in the outer layers of the flat good which abuts against the brake mechanism with respect to the speed of the band conveyor. Accordingly, the guiding structure which is located on the other side of the band conveyor formed by the drive device accelerates an individual item at the outer side of the flat good with respect to the speed of the band conveyor. Thus, the pre-shingled flat good is loaded on both sides and is shingled further.

It is advantageous for further processing, namely for the single pull-off, if in the device the parameters for braking (negative acceleration) and/or (positive) acceleration and/or of the conveyance speed are set in a way that the individual items lying on top of each other are fanned out a bit further, where the distance of the leading edges of the individual items and thereby the amount of the fanning-out after the processing does not fall below a certain adjustable minimum. It may be preferred to set the parameters in a way that the distance of the leading edges at the end of the processing is at least 5 cm. Therefore, the individual item at the head of the row constituted by the flat good has a head start towards the following individual item of at least 5 cm before it is pulled out of the row by the single pull-off. As a result, a reliable single pull-off is realized while avoiding multiple pull-offs.

As used herein, the term "flat good" includes a stack of flat items (individual items), where the individual items do not have to lie on top of each other in a tiling manner. A flat good may also be referred to as a batch. In case of the letters to be processed, they are processed in a row displaced towards each other. They are only stacked with respect to their lower edge (orientation edge) on which they stand. As used herein, each piece of a set "flat good" is called "individual item" or "individual flat item".

The advantages described herein ensure a high capacity throughput while avoiding the known problems previously discussed. Processing speeds of at least 3 to 4 m/sec and a capacity of up to 40000 letters per hour may be achieved, while conventional devices do not reach this speed.

In spite of the high processing speed, the flat good is nonetheless treated carefully and does not experience damage. Another advantage is the fact that the device can be realized in a compact assembly at low cost. Thereby, it can be integrated into existing systems without problems.

A further specialty lies in the fact that the disclosed concepts fulfill at least two functions. On the one hand the letters are settled and conveyed on their orientation edge on the free transport or settling line, as opposed to being clamped relatively tightly between two belts. On the other hand, the shingling of the letters takes place after the shingling smoothly. The disclosed concepts thereby combines in an ideal way the so-called settling with the singling.

In order to support the settling, it is advantageous if the flat goods are transported freely, resting upright on the band conveyor within a free transport distance with a certain lateral guidance, namely through adjacently abutting individual items, but nevertheless without lateral clamping. For the successful settling, the two opposite guiding structures within the free transport distance, namely the brake mechanism and the drive device, are located at such a distance to each other that even individual devices in the middle of thicker packs are freely transported through the guiding structures without lateral clamping. This allows the items to settle with their lower edge completely to the band conveyor. In one embodiment, the length of the free transport constitutes a comparatively large section of the transport channel. This allows for enough time for the settling, while the individual items on the free transport distance have the possibility, to abut with their lower edge completely against the band conveyor. With the supported settling, the lower edge becomes the defined orientation edge which is helpful in later processing.

As the method according to the disclosed concepts is at first relatively tolerant towards occasional fluctuations in the amount processed due to the guiding structures which are located at a satisfactory distance from each other. Thus, a buffer function is realized which balances stowage effectively. Such a buffer function is especially for the processing of such "chaotically" arranged flat good, such as letters, of an almost indispensable advantage.

In a form especially easy to be realized and therefore advantageous, the brake mechanism is formed by a wall with a high adhesion factor, against which the individual items located at one side of the flat good abut with one side. In practice, the wall can be formed by a plate part or a guide plate, whose surface is furnished with a friction lining. The friction lining can be a rubber-like material to which the letters stick. There it can be noted that, the larger the contact surface between individual item and wall is, the larger is the braking force, where the intensity of the contact pressure plays an important role. Such a brake mechanism is insofar self-regulating as in a thicker stack of flat good. It brakes the outer individual items further due to the stronger contact pressure, which, as needed in this case, leads to a stronger shingling and to a bigger buffer effect. If the contact pressure lessens with the reduction of the stack, the settling letters are freed and are processed in the direction of the single pull-off. In another embodiment, the brake mechanism can be formed by a slowly running side band whose surface has a high adhesion factor. This is advantageous to guarantee the equal abrasion of the surface and thereby to increase the tool life.

By seating the wall shiftably and/or pivoted at an approximate right angle towards the transport direction, the braking affect can be enhanced. The shifting of the wall can be initiated by certain measures, where a control to the processed amount of flat good shall be provided. It is, however, especially easy and inexpensive if the movement is initiated by a spring force which takes effect in the direction of the band conveyor. As a result, the transport channel is broadened automatically upon arrival of a thick stack, and the contact pressure remains the same during the reduction of the stack by the wall shifting. There, the strength of the spring force is advantageously adjustable. It is also advantageous if the movement of the brake mechanism in the direction of the band conveyor is limited by a stop, so that the channel always has a certain width. The shifting of the wall may operate switches and/or be monitored by sensors.

The shingling is especially effective if the lateral guiding structures, especially the side band and the wall of the brake mechanism, are arranged at an acute angle of only a few degrees, namely 1 to 5 degrees, towards one another, where the guiding structures converge in funnel-form in transport direction. Then, the angle and the distance is advantageously adjustable. Thus, the arriving flat good is braked in a kind of funnel, where at one side, the letters are accelerated by the drive belt. It is furthermore advantageous if the lateral guiding structures have approached each other before the single pull-off up to the average estimated thickness of a few, namely less than three individual items. So, a wedge effect is accomplished at the end of the free transport distance.

The method described in the course of this application as well as the device are advantageously introduced in a very early stage of mail processing, which is nowadays chiefly accomplished by manual work. In this early stage, the letters are delivered in sacks directly out of the letter-boxes, whose contents are emptied onto a band conveyor. From this mixed mail delivered as a heaped flat good, at first large-sized letters are sorted out manually. The remaining mails then have to be bundled, to be squared up with respect to their longitudinal edges (orientation edges) and to be packed into corresponding formatted and standardised boxes. The letters neatly pooled in the boxes can then be further processed. With the method and the device the letters can be readily prepared for being inserting into the box. This work was up to now performed manually.

In order to especially support this work, it is advantageous if the letters which lie on the band conveyor in a more or less uneven heap are fed onto a chute, lying on which they slide into a trench. There, the individual items hit the bottom of the trench with one edge and are held in the vertical position by the corresponding walls of the trench, which are standing together closely. By this, an alignment of the letters has taken place. At the bottom of the trench, a band conveyor is located which conveys the standing letters along the trench in the direction of the device. Now, the letters abut against each other in a shingle-like manner and can be further processed with the method according to the invention.

For this preparative method it is especially advantageous if the speed of the band conveyor which is located at the bottom of the trench and which is covered with a strongly frictional friction lining is set so highly that the letters hitting from the chute and/or the already aligned letters are tipped onto their orientation edge. So to say, the rug is pulled from under the letters which hit on their narrow edge, so that they automatically fall onto the edge which assure a preferably low centre of gravity.

This tendency is advantageously supported by the fact that the band conveyor at the bottom of the trench inclines at an angle of namely more than 30°. The letters standing on their narrow edges therefore have an even stronger tendency to tilt backwards. The special advantage of the trench and of the band conveyor are also, that the letters have a certain amount of time to settle completely to the orientation edge. There, it is advantageous to plan the length of the band conveyor and thereby of the trench sufficiently in order to ensure a settling of the letters.

Additional objects, advantages and novel features will be set forth in part in the description which follows, and in part will become apparent to those skilled in the art upon examination of the following and the accompanying drawings or may be learned by production or operation of the examples. The objects and advantages of the present teachings may be realized and attained by practice or use of the methodologies, instrumentalities and combinations particularly pointed out in the appended claims.

BRIEF DESCRIPTION OF THE DRAWINGS

The drawing figures depict one or more implementations in accord with the present teachings, by way of example only, not by way of limitation. In the figures, like reference numerals refer to the same or similar elements.

DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings.

Figure 1:
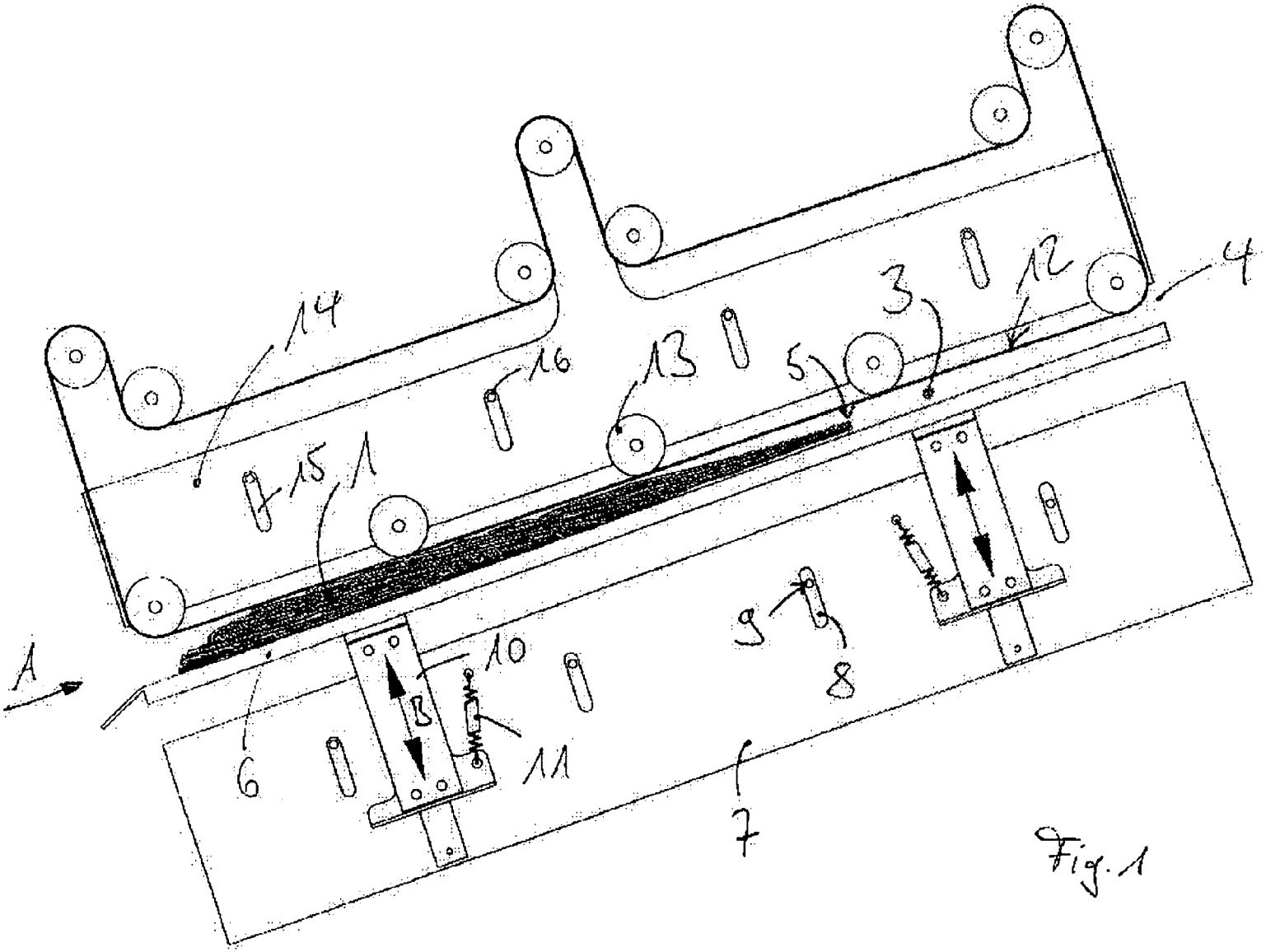
FIG. 1 illustrates a top view of the device according to the disclosed concepts.
Figure 2:
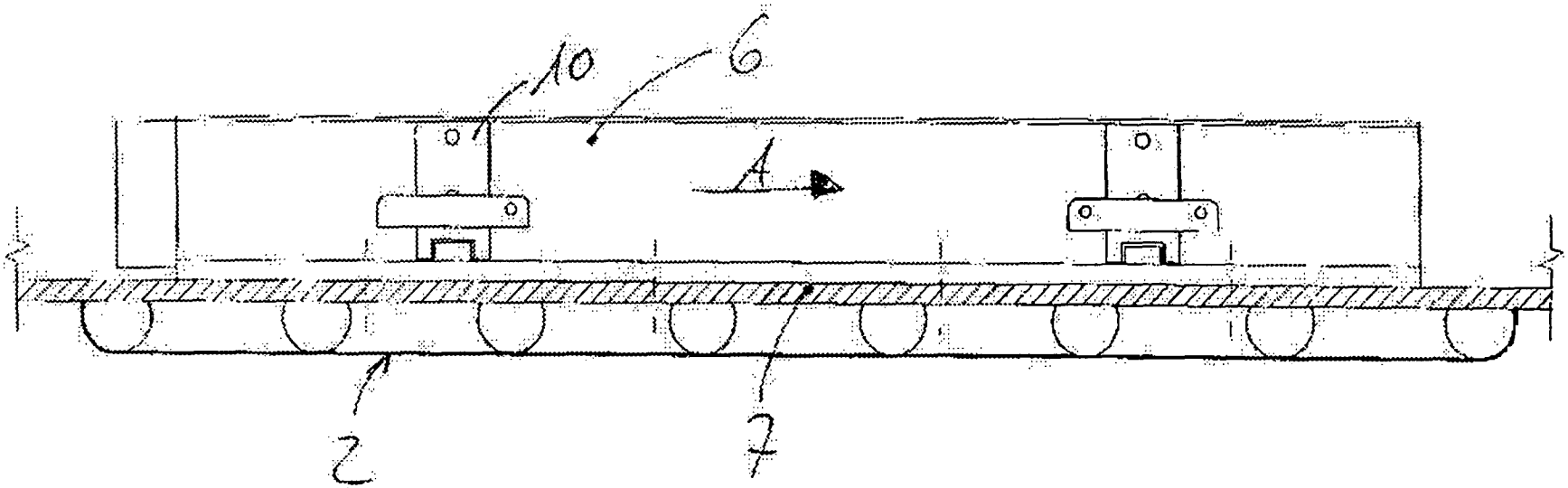
FIG. 2 illustrates a view of the device according to FIG. 1.

FIG. 1 illustrates a device for preparing of flat goods which are delivered in a bundled stack, namely a letter pack 1. The device comprises an underfloor belt 2 (shown in FIG. 2) or band conveyer 2 as a band conveyor, on which the letters 1 standing on a longitudinal edge (orientation edge) are conveyed in the direction of arrowhead A (letter running direction). The band conveyor 2 is limited laterally by guiding structures along a guiding line, where the band conveyor and the guiding structures form a transport channel 3, in which the letters 1 are held from toppling down. As shown in FIG. 1, the letter pack 1 is fanned out in the transport channel 3 to a row of letters which lie on top of each other in a shingle-like manner. The Transport path 3 converges into a single pull-off 4, which grabs the letter 5 arriving at the head of the row and advances it from the shingled row of letters 1.

The guiding structure located on one side, is formed by a brake mechanism 6, which brakes a letter located on the adjacent side of the letter pack 1 with respect to the speed of the band conveyor. The brake mechanism 6 comprises a wall with a high adhesion factor, against which the letters located at the right side of the letter pack 1 abut with some offset. The wall 6 is held on a mounting plate 7, which can be positioned in an acute angle towards transport direction A by screws 9 running in elongated holes 8. The mounting of the wall 6 takes place by means of two elements 10, which are held shiftable in the direction of arrowheads B. These elements 10 are loaded by springs 11, so that the wall 6 can automatically adjust to different fill levels. Thus, in this case, the right side is seated movably, where the movement is limited in the direction of the band conveyor by a stop.

The guiding structure, located on the other side in transport direction A, is constituted by a drive device, which accelerates a letter on the other side of the letter pack 1. The drive device comprises a driven side band 12, which has proportional to the band conveyor the same running direction A, but a higher speed. The adjacent letters are accelerated towards the single pull-off 4 by the side band 12. The side band 12 sort of wipes the separate letters off the top of the stack.

The side band 12 is seated on and driven by rollers 13. The rollers 13 are mounted on a belt plate 14 which can also be adjusted via screws 16 running in elongated holes 15 in a distance to the wall 6 and with respect to its angle. This once chosen setting may remain, however, throughout service. Although one may modify the screws to be adjustable throughout service.

In this case, the side band 12 and the wall 6 are positioned in an acute angle of approximately 2 degrees towards each other and converge in funnel-form in transport direction. The side band 12 and the wall 6 have approached each other before the single pull-off 4 up to the average estimated thickness of a few letters. Within the free transport distance, the wall 6 and the side band 12 are at such a distance to each other that letters within the letter pack 1 may be conveyed freely without lateral clamping and that they settle to the underfloor band with their orientation edge completely.

Figure 3:
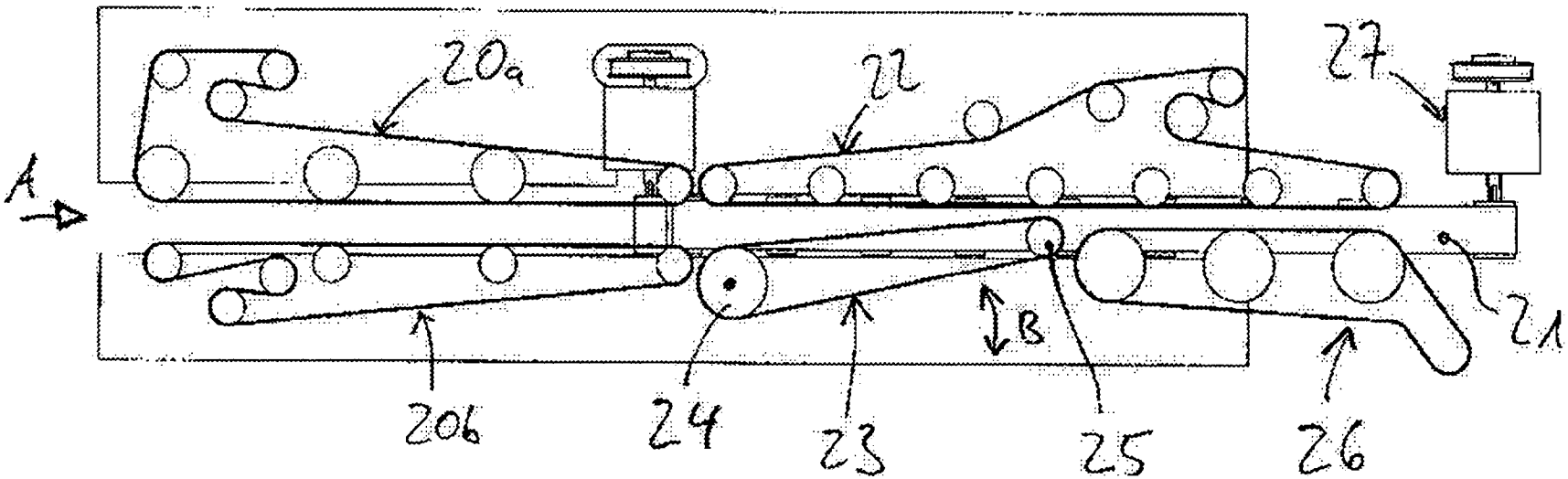
FIG. 3 illustrates a top view of another embodiment of the device according to the disclosed concepts.

FIG. 3 shows a modified form of the device according to FIG. 1. Again, the running direction is indicated with arrowhead A. The non-illustrated letters are conveyed on a non-illustrated underfloor band and are carried between two side bands 20*a* and 20*b* whose speed has been adapted. Thus conveyed, the letters arrive at an underfloor band 21 which is driven by motor 27 and thereby at a brake mechanism. In this case, the brake mechanism has, in addition to the accelerated side band 22, a braking side band 23 which rotates slowly around the rolls 24 and 25 in transport direction. The side band 23 has a high adhesion factor and can be pivoted around the axis of the roll 24 in the direction of arrowhead B at right angle to the transport direction. There, it is loaded with a spring force against the letters. The slow movement of the side band 23 leads to an equal abrasion of the friction lining. Behind the braking side band 23, a further side band 26 is located which leads the letters to the pull-off.

Figure 4:
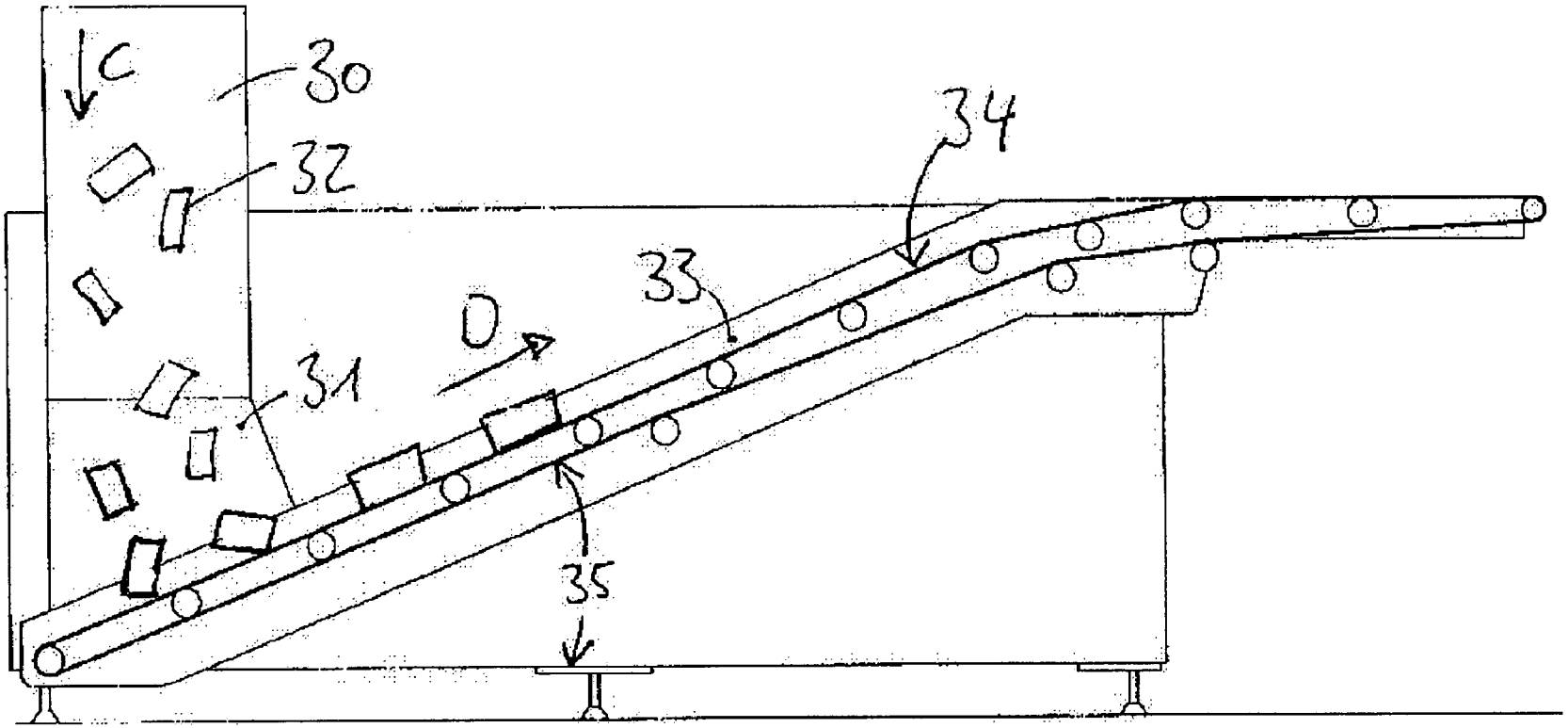
FIG. 4 illustrates a view of a ramp with a slanted trench.

FIG. 4 shows a ramp with a slanted trench. On a non-illustrated band conveyor, bundled letters 32 are fed towards a chute, which in this case comprises two chamfers 30 and 31, where the chamfer 30 has a lower inclination than the chamfer 31. The letters 32 slide in any orientation in the direction of arrowhead C down into a trench 33. There, the letters 32 hit the band conveyor 34 on the bottom of the trench with on edge and are held in the vertical position by the walls of the trench 33 which are standing together closely. The band conveyor 34 conveys them at high speed in the direction of arrowhead D. By means of the band conveyor 34 moving quickly in the direction of arrowhead D, the letters settle onto their long orientation edge. The tendency to settle onto the orientation edge is supported by the fact that the band conveyor at the bottom of the trench is inclined at an angle of 35°.

The disclosed concepts provide for a method for the preparatory processing of bundled flat goods 1 which can be realized by technically simple and inexpensive techniques. Advantageously, this allows for long tool life, great processing speed, and further reduction of staff. Other disclosed concepts provide for a device which can realize such a method without problems, which works reliably and treats individual flat goods gently.

Specifically, the disclosed concepts provide for a method for processing batched items 1, which may comprise a multitude of flats, e.g., letters. The individual items are conveyed in a row and abut against a band conveyor 2 with one edge. They are at least partially resting against and overlapping each other in a shingle-like manner. The overlapping flats are further separated (fanned out) by later processing steps described herein. The disclosed concepts further relate to a device for processing batched items 1, e.g., a multitude of flats. The device comprises a band conveyor 2 for conveying each flat standing on one edge, and where the band conveyor 2 comprises a guiding distance which is limited by guiding structures on both sides.

A fundamental aspect of the disclosed concepts lies in the fanning-out of the flat good 1 standing on edge on the band conveyor 2. The band conveyor 2 is constructed as an underfloor conveyor 2. One way to fan-out the flat good 1 is to preliminarily or periodically brake the stack of letters arriving in a row, which are lying on top of each other in a shingle-like manner. Specifically, the row of individual items is conveyed by the underfloor conveyor 2, braked by the brake mechanism 6 on one side and on the other side grabbed by drive devices and accelerated towards the single pull-off mechanism. By means of negative acceleration of the brake mechanism 6 on one side and by means of positive acceleration of the drive device 12 on the other side, the individual goods which are resting against each other in a shingle-like manner are increasingly fanned out.

More particularly, the flat goods 1 conveyed by the band conveyor 2 is lead towards the brake mechanism 6 with one flat edge before reaching the single pull-off. Relative to the braking mechanism 6, at first the band conveyor 2 transports or conveys the letters in the middle layers of the flat good more than the letters which abut against the brake mechanism 6 because those that abut are slowed with respect to the conveyance speed of the band conveyor 2. Thus, the individual goods are increasingly shingled even more than before. On the opposite side, the flat good 2 is engaged by a driven side band 12 such that each of the engaged items is accelerated in the direction of the single pull-off. This measure, too, contributes to further shingling. However, it is not necessary to perform both measures simultaneously on the same section of the band conveyor. They can also affect the letters in succession.

The brake mechanism 6 is configured to brake an individual item in the outer layers of the flat good 1 which abuts against the brake mechanism 6 with respect to the speed of the band conveyor 2. Accordingly, the guiding structure which is located on the other side of the band conveyor 2 formed by the drive device 12 accelerates an individual item at the outer side of the flat good 2 with respect to the speed of the band conveyor 2. Thus, the pre-shingled flat good 1 is loaded on both sides and is shingled further.

It is advantageous for further processing, namely for the single pull-off, if in the device the parameters for braking (negative acceleration) and/or (positive) acceleration and/or of the conveyance speed are set in a way that the individual items lying on top of each other are fanned out a bit further, where the distance of the leading edges of the individual items and thereby the amount of the fanning-out after the processing does not fall below a certain adjustable minimum. It may be preferred to set the parameters in a way that the distance of the leading edges at the end of the processing is at least 5 cm. Therefore, the individual item at the head of the row constituted by the flat good 1 has a head start towards the following individual item of at least 5 cm before it is pulled out of the row by the single pull-off. As a result, a reliable single pull-off is realized while avoiding multiple pull-offs.

In order to support the settling of individual items, it is advantageous if the flat goods 1 are transported freely, resting upright on the band conveyor 2 within a free transport distance with a certain lateral guidance, namely through adjacently abutting individual items, but nevertheless without lateral clamping. For the successful settling, the two opposite guiding structures within the free transport distance, namely the brake mechanism 6 and the drive device 12, are located at such a distance to each other that even individual devices in the middle of thicker packs are freely transported through the guiding structures without lateral clamping. This allows the items to settle with their lower edge completely to the band conveyor. In one embodiment, the length of the free transport constitutes a comparatively large section of the transport channel. This allows for enough time for the settling, while the individual items on the free transport distance have the possibility to abut with their lower edge completely against the band conveyor. With the supported settling, the lower edge becomes the defined orientation edge which is helpful in later processing.

As the method according to the disclosed concepts is at first relatively tolerant towards occasional fluctuations in the amount processed due to the guiding structures which are located at a satisfactory distance from each other. Thus, a buffer function is realized which balances stowage effectively. Such a buffer function is especially for the processing of such "chaotically" arranged flat good, such as letters, of an almost indispensable advantage.

In a form especially easy to be realized and therefore advantageous, the brake mechanism 6 is formed by a wall with a high adhesion factor, against which the individual items located at one side of the flat good 1 abut with one side. In practice, the wall can be formed by a plate part or a guide plate, whose surface is furnished with a friction lining. The friction lining can be a rubber-like material to which the letters stick. There it can be noted that, the larger the contact surface between individual item and wall is, the larger is the braking force, where the intensity of the contact pressure plays an important role. Such a brake mechanism 6 is insofar self-regulating as in a thicker stack of flat good. It brakes the outer individual items further due to the stronger contact pressure, which, as needed in this case, leads to a stronger shingling and to a bigger buffer effect. If the contact pressure lessens with the reduction of the stack, the settling letters are freed and are processed in the direction of the single pull-off. In another embodiment, the brake mechanism 6 can be formed by a slowly running side band whose surface has a high adhesion factor. This is advantageous to guarantee the equal abrasion of the surface and thereby to increase the tool life.

By seating the wall shiftably and/or pivoted at an approximate right angle towards the transport direction, the braking affect can be enhanced. The shifting of the wall can be initiated by certain measures, where a control to the processed amount of flat good shall be provided. It is, however, especially easy and inexpensive if the movement is initiated by a spring force which takes effect in the direction of the band conveyor. As a result, the transport channel is broadened automatically upon arrival of a thick stack, and the contact pressure remains the same during the reduction of the stack by the wall shifting. There, the strength of the spring force is advantageously adjustable. It is also advantageous if the movement of the brake mechanism in the direction of the band conveyor is limited by a stop, so that the channel always has a certain width. The shifting of the wall may operate switches and/or be monitored by sensors.

The singling is especially effective if the lateral guiding structures, especially the side band and the wall of the brake mechanism, are arranged at an acute angle of only a few degrees, namely 1 to 5 degrees, towards one another, where the guiding structures converge in funnel-form in transport direction. Then, the angle and the distance is advantageously adjustable. Thus, the arriving flat good is braked in a kind of funnel, where at one side, the letters are accelerated by the drive belt. It is furthermore advantageous if the lateral guiding structures have approached each other before the single pull-off up to the average estimated thickness of a few, namely less than three individual items. So, a wedge effect is accomplished at the end of the free transport distance.

The method described in the course of this application as well as the device are advantageously introduced in a very early stage of mail processing, which is nowadays chiefly accomplished by manual work. In this early stage, the letters are delivered in sacks directly out of the letter-boxes, whose contents are emptied onto a band conveyor. From this mixed mail delivered as a heaped flat good, at first large-sized letters are sorted out manually. The remaining mails then have to be bundled, to be squared up with respect to their longitudinal edges (orientation edges) and to be packed into corresponding formatted and standardised boxes. The letters neatly pooled in the boxes can then be further processed. With the method and the device the letters can be readily prepared for being inserting into the box. This work was up to now performed manually.

In order to especially support this work, it is advantageous if the letters which lie on the band conveyor in a more or less uneven heap are fed onto a chute, lying on which they slide into a trench. There, the individual items hit the bottom of the trench with one edge and are held in the vertical position by the corresponding walls of the trench, which are standing together closely. By this, an alignment of the letters has taken place. At the bottom of the trench, a band conveyor is located which conveys the standing letters along the trench in the direction of the device. Now, the letters abut against each other in a shingle-like manner and can be further processed with the method according to the invention.

Here, it is explicitly annotated that this way of preparing is independent upon later processing through the method according to the invention. The device according to the invention and may with its features constitute an invention of its own.

For this preparative method it is especially advantageous if the speed of the band conveyor which is located at the bottom of the trench and which is covered with a strongly frictional friction lining is set so highly that the letters hitting from the chute and/or the already aligned letters are tipped onto their orientation edge. So to say, the rug is pulled from under the letters which hit on their narrow edge, so that they automatically fall onto the edge which assure a preferably low centre of gravity.

This tendency is advantageously supported by the fact that the band conveyor at the bottom of the trench inclines at an angle of namely more than 30°. The letters standing on their narrow edges therefore have an even stronger tendency to tilt backwards. The special advantage of the trench and of the band conveyor are also, that the letters have a certain amount of time to settle completely to the orientation edge. There, it is advantageous to plan the length of the band conveyor and thereby of the trench sufficiently in order to ensure a settling of the letters.

By seating the wall shiftably and/or pivoted at an approximate right angle towards the transport direction, the braking affect can be enhanced. The shifting of the wall can be initiated by certain measures, where a control to the processed amount of flat good shall be provided. It is, however, especially easy and inexpensive if the movement is initiated by a spring force which takes effect in the direction of the band conveyor. As a result, the transport channel is broadened automatically upon arrival of a thick stack, and the contact pressure remains the same during the reduction of the stack by the wall shifting. There, the strength of the spring force is advantageously adjustable. It is also advantageous if the movement of the brake mechanism in the direction of the band conveyor is limited by a stop, so that the channel always has a certain width. The shifting of the wall may operate switches and/or be monitored by sensors.

What is claimed is:

1. A method for processing a batch comprising individual flat items, where the individual flat items are at least partially resting against each other and are overlapping each other in a shingled array, and where the overlapping individual flat items are further separated by the following process steps:

conveying the batch on a bottom edge by way of a band conveyor at a conveyance speed;

decelerating a first side of the batch relative to the conveyance speed;

accelerating a second side of the batch relative to the conveyance speed by way of a side band to form a row of individual flat items in the shingled array; and separating an individual flat item from the batch, wherein the side band is driven at a higher speed than the conveyance speed of the band conveyor.

2. The method according to claim 1, further comprising the step of feeding the separated individual flat item for a single pull-off.

3. The method according to claim 1, wherein the individual flat item is conveyed standing on edge.

4. The method according to claim 1, further comprising the step of setting parameters of deceleration or acceleration or transport speed such that an individual flat item at the head of the row is separated from an individual flat item in the row of at least a predetermined distance.

5. The method according to claim 1 wherein the batch is transported freely on the at least one edge without lateral clamping.

6. The method according to claim 1, further comprising the steps of conveying a plurality of batches in a heap;

separating each of the plurality of batches from the heap; and orientating each of the plurality of batches on an edge.

7. The method according to claim 6, further comprising the step of setting the conveyance speed such that that upstanding individual flat items are tipped onto their longitudinal edge.

8. A device for processing a batch comprising individual flat items, comprising:

a band conveyor for conveying the batch standing on edge;

a transport channel formed by:

a brake mechanism on a first side, an acceleration mechanism on a second side, said acceleration mechanism comprising a side band driven at a higher speed than a conveying speed of the band conveyor, and the band conveyor on a third side of the transport channel, wherein the individual flat items of the batch are fanned out through the conveying speed of the band conveyor, braking of the brake mechanism and accelerating of the acceleration mechanism to form a row of individual flat items; and a chute, over which the batch is delivered, in which the individual flat items lying heaped on top of each other fall into a trench, wherein the individual flat items hit the bottom of the trench on one edge, and wherein the trench has walls, which hold the individual flat items in the standing position, and where there is a band conveyor at the bottom of the trench, which conveys the standing individual flat items along a bottom edge across the trench to the transport channel, wherein the band conveyor inclines at an angle of more than 30° at the bottom of the trench relative to a horizontal surface positioned below the band conveyor.

9. The device according to claim 8, further comprising a single pull-off positioned to separate an individual flat item at the head of the row.

10. The device according to claim 8, further comprising a free transport portion forming at least part of the transport channel, wherein the brake mechanism and the acceleration mechanism are separated by a distance such that individual items of the flat batch may be conveyed by the band conveyor without substantial influence from the brake mechanism or the acceleration mechanism.

11. The device according to claim 8, wherein the brake mechanism comprises a wall having an adhesion factor against which the individual flat items on one side of the batch abut.

12. The device according to claim 8, wherein the brake mechanism comprises a side band against which the individual flat item on one side of the batch abut, where the side band moves at a slower speed as the band conveyor but in the same direction.

13. The device according to claim 8, wherein the acceleration mechanism comprises a drive device for driving the side band running in the same direction of the band conveyor but at the higher speed, wherein the individual flat item abutting against the drive device are accelerated.

14. The device according to claim 8, wherein the acceleration mechanism and brake mechanism are arranged at an acute angle and converge in funnel-form in the transport direction.

15. The device according to claim 14, wherein the funnel-form converges to a separation distance of less than three individual items.

16. The device according to claim 8, wherein the brake mechanism is seated shiftably or pivoted at right angle towards the transport direction, and the brake mechanism is loaded with a spring force in the direction of the band conveyor.

17. The device according to claim 8, wherein the length of the transport channel is sufficient to ensure a settling of the individual flat items before being inserted into the transport channel.

18. A device comprising:

a continuous chute comprising an upper chamfer directly connected to and in-line with a lower chamfer, the upper chamfer having a first inclination less than a second inclination of the lower chamfer, the chute adapted to deliver a batch of individual flat items, in which the individual flat items are lying heaped on top of each other;

a trench positioned below the lower chamfer of the chute, adapted to receive the individual flat items from the lower chamfer of the chute on one edge, wherein the trench includes side walls which hold the individual items in a standing position; and a band conveyor being associated with the trench and the band conveyor being inclined at an angle of more than 30° relative to a horizontal surface, the band conveyor adapted to convey the standing individual flat items along a bottom edge across the trench to a transport channel, wherein the horizontal surface is positioned below the band conveyor.

* * * * *